US007538301B2

(12) United States Patent
Teufl et al.

(10) Patent No.: US 7,538,301 B2
(45) Date of Patent: May 26, 2009

(54) TUBULAR HEATING ELEMENT WITH CONICAL HEATING COIL

(75) Inventors: Gernot Teufl, Hallein (AT); Andreas Pleschinger, Anthering (AT)

(73) Assignee: Bleckmann GmbH & Co., KG (AT)

( * ) Notice: Subject to any disclaimer, the term of this patent is extended or adjusted under 35 U.S.C. 154(b) by 0 days.

(21) Appl. No.: 11/379,074

(22) Filed: Apr. 18, 2006

(65) Prior Publication Data

US 2006/0249508 A1 Nov. 9, 2006

(30) Foreign Application Priority Data

Apr. 25, 2005 (DE) ..... 10 2005 019 211

(51) Int. Cl.
*H05B 3/06* (2006.01)

(52) U.S. Cl. ..... 219/523; 219/237; 219/541; 29/611

(58) Field of Classification Search ..... 219/523, 219/534, 535, 541, 544, 548, 552, 553; 392/448, 392/481, 487, 497, 500, 503, 489
See application file for complete search history.

(56) References Cited

U.S. PATENT DOCUMENTS

| | | | | | |
|---|---|---|---|---|---|
| 2,727,979 | A | * | 12/1955 | Altosaar | 392/448 |
| 2,978,563 | A | * | 4/1961 | Hackman | 392/379 |
| 3,259,732 | A | | 7/1966 | Jepson | |
| 3,521,352 | A | | 7/1970 | Volker | |
| 3,716,693 | A | * | 2/1973 | Bleckmann | 219/553 |
| 3,943,328 | A | * | 3/1976 | Cunningham | 392/503 |
| 3,982,099 | A | * | 9/1976 | Churchill | 219/544 |
| 4,281,451 | A | | 8/1981 | Mann | |
| 4,390,776 | A | * | 6/1983 | Yane et al. | 219/523 |
| 5,774,627 | A | * | 6/1998 | Jackson | 392/497 |
| 6,078,730 | A | * | 6/2000 | Huddart et al. | 392/480 |
| 7,449,661 | B1 | * | 11/2008 | Bench | 219/201 |

FOREIGN PATENT DOCUMENTS

| | | | |
|---|---|---|---|
| CH | 360144 | A | 2/1962 |
| DE | 909 487 | | 4/1954 |
| DE | 943 851 | | 6/1956 |
| DE | 1 081 720 | | 5/1960 |
| DE | 1081720 | * | 5/1960 |
| DE | 1 829 093 | U | 4/1961 |
| DE | 1 133 483 | | 7/1962 |
| DE | 21 24 028 | | 12/1971 |
| DE | 73 41 597 | | 2/1974 |
| GB | 969635 | * | 9/1964 |
| GB | 969635 | A | 9/1964 |

* cited by examiner

*Primary Examiner*—Tu B Hoang
*Assistant Examiner*—Vinod D Patel
(74) *Attorney, Agent, or Firm*—Hahn Loeser & Parks, LLP; Michael H. Minns

(57) ABSTRACT

A tubular heating element for heating fluid media, in particular for household appliances, comprising a jacket pipe inside which there is disposed at least one heating coil made of an electrical resistance heating wire and embedded in an electrical insulation material, the heating coil having a first and a second terminal portion by means of which the heating coil is connected to a source of current via at least one connection element at each end, and at least one operating portion extending between the two terminal portions of the heating coil. It is further specified that the diameter of said heating coil increases at at least one terminal portion in the direction of the operating portion.

10 Claims, 4 Drawing Sheets

TUBULAR HEATING ELEMENT WITH CONICAL HEATING COIL

CROSS-REFERENCE TO RELATED APPLICATIONS

This application claims the benefit of German priority application DE 10 2005 019 211 of the same inventors, filed Apr. 25, 2005.

TECHNICAL FIELD

The present invention relates to a tubular heating element for heating fluid media, specifically to a tubular heating element for household appliances and to a heating coil for such a tubular heating element.

BACKGROUND OF THE INVENTION

Such tubular heating elements may be used wherever a fluid medium is to be heated. This is particularly the case with various household appliances such as washing machines, dishwashers, coffee machines, etc.

In some of these applications, the length of the tubular heating element and the diameter of its heating coil, factors which co-determine its heating capacity, can be freely defined depending on the desired performance features, since the available space for installation for the tubular heating element is not subject to restrictions. Only at the terminal ends of this tubular heating element is it necessary to reduce the heating capacity, because in most cases the medium to be heated circulates only partially or not at all around these areas, with the consequence that the heat produced there is not transported away to a sufficient extent. This means that if the same heating capacity is generated in the area of the terminal ends as in the rest of the tubular heating element, this could result in damage to the heating coil due to overheating. For this reason, connection elements such as terminal pins, etc., are inserted into the inside of the jacket pipe in the terminal portion of the tubular heating element in order to prevent the generation of heat there. This is why the terminal end portions of the tubular heating element are also referred to as the "cold" ends.

The problems outlined above are greatly exacerbated in fields of application in which only little space is available for installing the tubular heating element, but a high heating capacity is still required. In order to achieve good heat transfer to the jacket pipe, it may be necessary to increase the diameter of the heating coil accordingly. However, this results in a high heating capacity likewise being present at the terminal ends, which can lead to the problems already outlined in the foregoing. In tubular heating elements of this kind, that is to say in tubular heating elements with a short overall length and large heating capacity, what can also be done in many cases is that the tubular heating element is bent at its terminal ends in order to have an easy connection to a voltage source. When the heating element is bent in this way, the heating coil inside the jacket pipe of the tubular heating element is also bent along its longitudinal axis, which leads to undefined deformation of the heating coil. The spiral coil may also be displaced in parts, leading to locally overheated areas due to uneven transfer of heat.

The terminal end portion of a known tubular heating element is shown in FIG. 4. This tubular heating element has a heating coil 22' embedded in an electrically insulating material 20' inside a jacket pipe 10'. Heating coil 22' is connected on this side to a source of current by means of a terminal pin 24'. To prevent the separate spirals of heating coil 22' from taking up an undefined position in the bent or curved portion 18', the terminal pin is guided beyond the curved portion of jacket pipe 10' into the inside of the tubular heating element, where the heating coil 22' is finally connected to terminal pin 24'. However, the heating capacity is further reduced as a result, because appropriate heating capacity is not present until heating coil portion 22'. The diameter of heating coil 22' is also adapted to the diameter of terminal pin 24'. Since the diameter of pin 24' is small compared to the inner diameter of jacket pipe 10', only a small heating capacity can be produced when the jacket pipe has such a maximum diameter.

SUMMARY OF THE INVENTION

It is an object to provide a tubular heating element and a heating coil of the kind initially specified that allows the length of the tubular heating element to be put to optimal use despite its having a high heating capacity.

In a certain embodiment, by increasing the diameter of the heating coil at at least one terminal end portion in the direction towards the operating portion of the heating coil, it is possible to reduce the heating capacity in the critical terminal portion without reducing the usable length of the tubular heating element. This means that the heating coil can be reduced in diameter from that of the operating portion, where the diameter is large, to a diameter that is favourable for the terminal portion. As a result, the heating coil acquires a shape that is at least approximately conical, at one terminal end portion at least.

The diameter of the heating coil can basically be increased continuously, in at least portions thereof, beginning at the free end of the heating coil and proceeding in the direction of the operating portion. It is likewise possible for the diameter of the heating coil to be increased discontinuously in at least portions thereof. The heating coil can be provided in such a form, for example, that it initially has a constant diameter, commencing at its free end, with the diameter then increasing continuously or discontinuously in the direction of the operating portion, before transitioning to a constant diameter extending across the entire operating portion. The diameter can be increased discontinuously at the terminal end portion of the heating coil by providing one or more step-like increases in the diameter of the heating coil.

In addition to increasing the diameter of the heating coil at the terminal end portion, the pitch of the spiral coil can also be designed to be constant in said region. It is likewise possible for the increase in pitch of the heating coil to be variable at least in portions thereof in at least one terminal portion. For example, the pitch of the heating coil can be chosen to be initially constant and very small, commencing at its free end, and then to have a relatively large value while the diameter also increases, preferably continuously, and in the operating portion of the heating coil having an equally constant pitch value and a equally constant diameter.

As has already been described above in connection with the prior art, it may be necessary to bend the tubular heating element at one or both terminal ends in order to facilitate contact between the terminal end of the tubular heating element and a source of current. By means of a tubular heating element designed with a heating coil, the diameter of which increases at the terminal end portion in the direction of the operating portion, it is possible to provide the heating coil as well with at least one bend in its longitudinal axis at its terminal end portion.

Production of the heating coil and the tubular heating element can be made particularly simple by configuring both terminal end portions of the heating coil in the same way.

Quite different components can be used as the connection element. One particularly favourable connection element is in the form of a terminal pin made of a good electrical conducting material, the terminal pin being insertable into the inside of the heating coil and the outer diameter of the terminal pin matching the inner diameter of the heating coil at least in the region of the terminal end of the heating coil. It is particularly favourable if the diameter of the heating coil is constant in the region of the connection element.

BRIEF DESCRIPTION OF THE DRAWINGS

Other advantageous configurations of the tubular heating element and the heating coil, as well as embodiments thereof shall now be described with reference to the attached drawings. The terms "left", "right", "bottom" and "top" used when describing the embodiments relate to the attached drawings oriented in such a way that the reference numerals and names of the figures can be read normally. The drawings show.

DETAILED DESCRIPTION OF THE INVENTION

Figure 1:
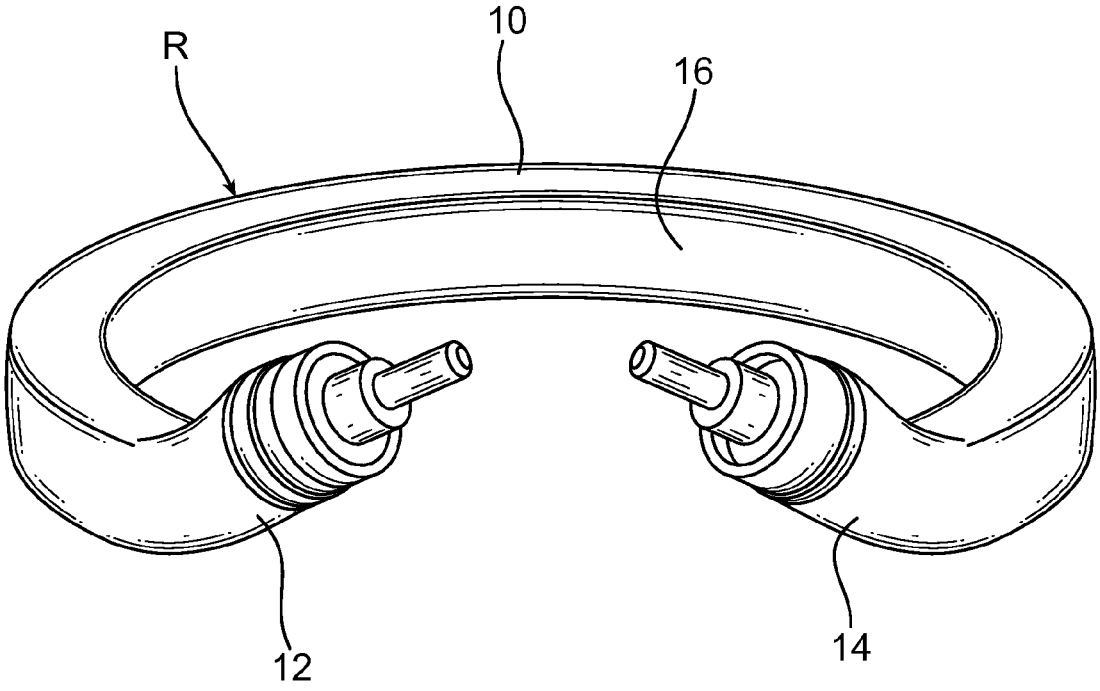
FIG. 1 a perspective view of a tubular heating element.

An electrical tubular heating element R is shown schematically in FIG. 1. Said heating element firstly comprises a jacket pipe 10 made of a material with good thermal conductance, such as aluminium or corrosion-resistant steel. Jacket pipe 10, and hence tubular heating element R, can be shaped in a manner that is favourable for the respective application. In the present case, jacket pipe 10 is bent into an open circular ring. Jacket pipe 10 can have different cross-sectional profiles. As can be seen from FIG. 1, jacket pipe 10 has a generally quadratic cross-section with flattened corners.

Tubular heating element R has two terminal end portions 12, 14 across which tubular heating element R can be connected to a source of current that is not shown in any further detail. A principal heat transfer region 16 of tubular heating element R extends between the two terminal end portions 12, 14. In the region of the two terminal ends 12, 14, tubular heating element R is designed with a bend 18. By this means, terminal end portions 12, 14 are guided upwards out of the plane of the principal heat transfer region 16 of tubular heating element R, thus facilitating contact with the source of current.

Figure 2:
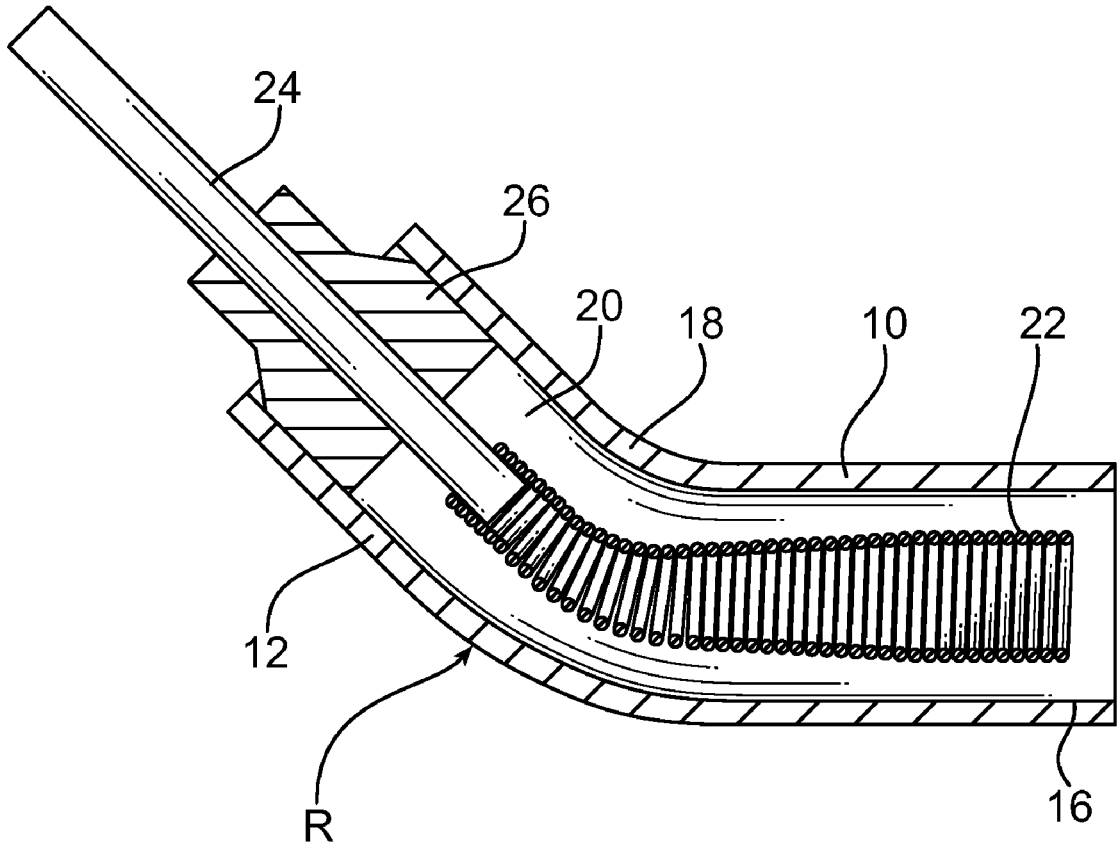
FIG. 2 a schematic sectional view of a terminal end of the tubular heating element shown in FIG. 1, at a larger scale than that shown in FIG. 1.

It can be seen from FIG. 2 that jacket pipe 10 is filled with an electrically insulating but heat conducting material 20, such as magnesium oxide, that can be compacted if necessary by rolling and/or compressing it. Insulation material 20 encloses a heating coil 22 shown schematically in FIG. 2 and in detail in FIG. 3.

Figure 3:
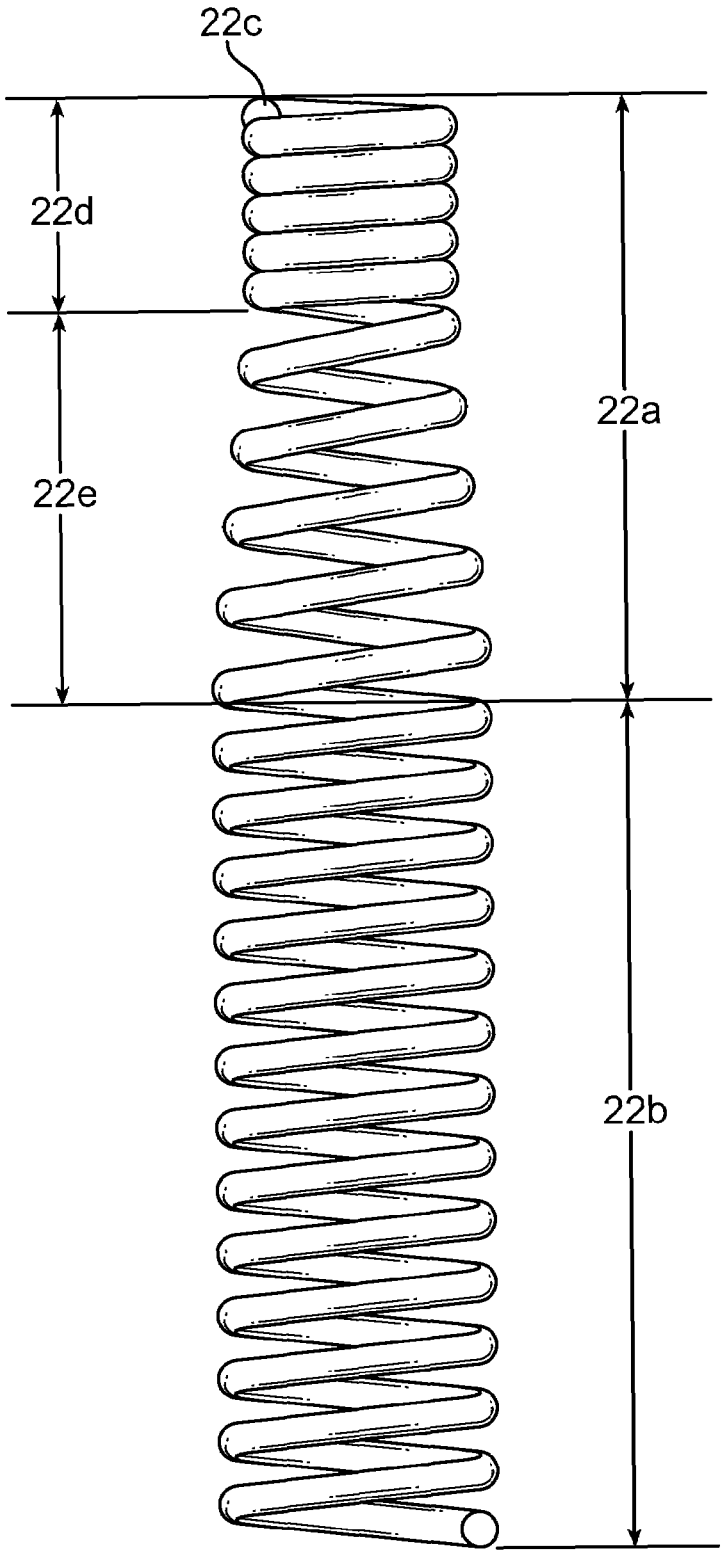
FIG. 3 a partial side elevation view of a heating coil.
Figure 4:
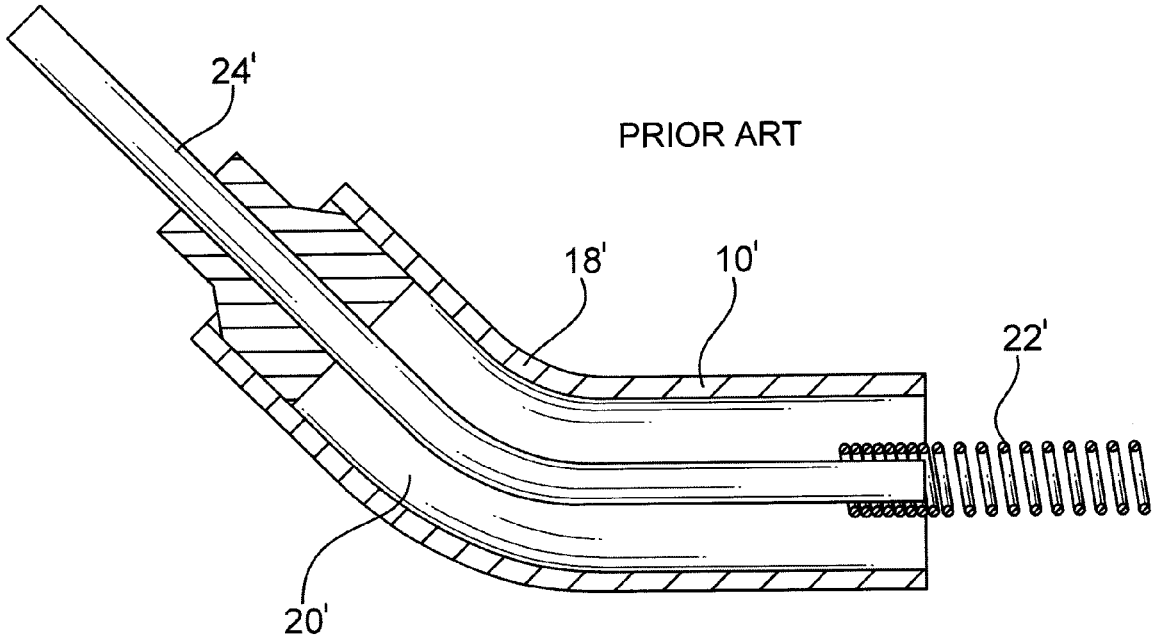
FIG. 4 a sectional view, similar to that in FIG. 2, of a terminal end of a known tubular heating element.

As can be seen from FIG. 3, the wound heating coil 22 has a terminal portion 22*a* and an operating portion 22*b* that corresponds at least approximately to the aforementioned principal heat transfer region 16 of tubular heating element R. In terminal portion 22*a*, heating coil 22 has a first portion 22*d* of constant diameter, as viewed from its free end 22*c*. Adjacent to said first portion but still inside terminal portion 22*a* there is a second portion 22*e* in which the diameter of heating coil 22 increases uniformly from the diameter in the first portion 22*d* to a diameter that then remains constant within operating portion 22*b*. In the first portion 22*d*, in which its diameter is constant, heating coil 22 also has a pitch that is smaller than the pitch in the second portion 22*e* of terminal portion 22*a* and operating portion 22*d*. It should also be noted that the pitch of heating coil 22 can be different in the second portion 22*e* of terminal portion 22*a* to that in the operating portion. It should be further noted that heating coil 22 also emits heat in its terminal portion 22*a*, but that this emission of heat is less in this portion compared to the heat emitted in the operating portion 22*b* of heating coil 22. It should finally be noted that heating coil 22 can be of identical design at its other end to the end shown in FIG. 2 and described in the foregoing.

As can also be seen from FIG. 2, heating coil 22 is connected by means of a terminal pin 24 to the outside of tubular heating element R. Terminal pin 24 is made of a material with good electrical conductance, and has a generally cylindrical cross-section of constant diameter. Terminal pin 24 is fed through an insulating bead 26 made of ceramics or similar material in order to fix it in place. Heating coil 22 is joined in the region of the first portion 22*d* of terminal portion 22*a* to terminal pin 24 by welding the two together.

Finally, and as can also be seen from FIG. 2, heating coil 22 is curved along its longitudinal axis L in the terminal end portion 12 of tubular heating element R and thus follows the bend 18 in tubular heating element R.

While there have been shown and described and pointed out fundamental features of the invention as applied to the preferred embodiments thereof, it will be understood that various omissions and substitutions and changes in the form and details of the devices described may be made by those skilled in the art without departing from the present invention. For example, it is expressly intended that all combinations of those elements, which perform substantially the same function in substantially the same way to achieve the same results, are within the scope of the invention. Moreover, it should be recognized that structures and/or elements and/or described in connection with any disclosed form or embodiment of the invention may be incorporated in any other disclosed or described or suggested form or embodiment as a general matter of designed choice. It is the intention, therefore, to be limited only as indicated by the scope of the claims appended hereto.

Finally but yet importantly, it is noted that the term "comprises" or "comprising" when used in the specification including the claims is intended to specify the presence of stated features, means, steps or components, but does not exclude the presence or addition of one or more other features, means, components or group thereof. Further, the word "a" or "an" preceding an element in a claim does not exclude the presence of a plurality of such elements.

We claim:

1. A tubular heating element for heating fluid media comprising:

a jacket pipe, at least one heating coil disposed inside the jacket pipe, the coil made of an electrical resistance heating wire and embedded in an electrical insulation material, wherein the heating coil comprises a first and a second terminal portion by means of which said heating coil is connectable to a source of current via at least one connection element at each end, the heating coil further comprising at least one operating portion extending between the two terminal portions of the heating coil, wherein the jacket pipe has at least one bend in its longitudinal axis in one of the terminal portions having a bended terminal portion, at said bended terminal portion the diameter of said heating coil increases in the bend of the jacket pipe in the direction of the operating portion wherein, a portion of said heating coil with said increasing diameter being position within said bended terminal portion and also being bent, in operation, emission of heat is less in the terminal portion compared to the heat emitted in the operating portion, and such that locally overheated areas due to uneven transfer of heat caused by displacement of the heating coil in the bended terminal portion is avoided.

2. The tubular heating element according to claim 1, wherein the diameter of the heating coil increases continuously in at least portions thereof.

3. The tubular heating element according to claim 1, wherein the diameter of the heating coil increases discontinuously in at least portions thereof.

4. The tubular heating element according to claim 1, wherein the diameter of the heating coil is at least approximately constant in the operating portion.

5. The tubular heating element according to claim 1, wherein the pitch of the spiral of the heating coil is constant in the bended terminal portion.

6. The tubular heating element according to claim 1, wherein the pitch of the spiral of the heating coil is variable at least in portions thereof in the bended terminal portion.

7. The tubular heating element according to claim 1, wherein both terminal end portions are identical in design.

8. The tubular heating element according to claim 1, wherein the connection element is in the form of a terminal pin inserted into the inside of the heating coil and the outer diameter of which matches the inner diameter of the heating coil at least in the terminal end portion of the heating coil.

9. The tubular heating element according to claim 8, wherein the diameter of the heating coil is constant in the region of the connection element.

10. The tubular heating element according to claim 1, wherein the diameter of the heating coil is constant in the region of the connection element.

* * * * *